US006598250B1

(12) United States Patent
Pekar

(10) Patent No.: US 6,598,250 B1
(45) Date of Patent: Jul. 29, 2003

(54) PRESSURE REGULATION FOR AN INFLATABLE CUSHION

(75) Inventor: Robert W. Pekar, Florence, MA (US)

(73) Assignee: Dielectrics Industries, Inc., Chicopee, MA (US)

( * ) Notice: Subject to any disclaimer, the term of this patent is extended or adjusted under 35 U.S.C. 154(b) by 146 days.

(21) Appl. No.: 09/705,974

(22) Filed: Nov. 3, 2000

(51) Int. Cl.[7] ..... A47C 27/08
(52) U.S. Cl. ..... 5/654; 5/709; 5/710
(58) Field of Search ..... 5/706, 709, 710, 5/712, 713, 654

(56) References Cited

U.S. PATENT DOCUMENTS 4,371,997 A 2/1983 Mattson
4,774,735 A * 10/1988 Sanderson et al. ..... 5/655.3
4,788,729 A 12/1988 Walker
4,833,457 A * 5/1989 Graebe, Jr. ..... 200/85 A
4,899,406 A 2/1990 Sanderson et al.
5,121,962 A * 6/1992 Weber et al. ..... 297/199
5,142,717 A * 9/1992 Everard et al. ..... 5/709
5,444,881 A 8/1995 Landi et al.
5,868,463 A 2/1999 MacKenzie et al.
5,916,336 A * 6/1999 Middleton ..... 68/18 C
6,047,423 A * 4/2000 Larson ..... 5/709
6,073,290 A * 6/2000 Miller, Sr. ..... 5/710
6,159,172 A * 12/2000 Gray et al. ..... 297/452.41
6,385,804 B1 * 5/2002 Barber et al. ..... 137/614.2

* cited by examiner

*Primary Examiner*—Michael F. Trettel
(74) *Attorney, Agent, or Firm*—Cantor Colburn LLP

(57) ABSTRACT

An inflatable cushion is disclosed, having features that allow deflation of the cushion to be controlled. The cushion includes an inflatable bladder having a support therein and a valved exhaust tube in fluid communication therewith. An indicator coupled to the exhaust tube indicates when fluid is exiting the exhaust tube. When sat upon, the cushion deflates only by a preselected amount. This allows the cushion to be consistently and easily deflated to a predetermined inflation height.

12 Claims, 2 Drawing Sheets

PRESSURE REGULATION FOR AN INFLATABLE CUSHION

BACKGROUND

This invention relates to inflatable cushions. One application of inflatable cushions is for people who sit for extended periods of time, such as wheelchair users. After extended periods of remaining seated, a person's body will commonly become uncomfortable and sore, and might even develop bedsores. The weight of the seated person's body is typically supported only at a limited number of points creating pressure points on the body, which can become painful and sore over time. This problem can be alleviated by seating the person on an inflatable cushion that has been inflated enough to provide support, but not so much that the cushion can't conform to the shape of the seated person's backside and legs. It is this conformability that allows the person's weight to be distributed more evenly over the entire surface of his backside and legs that is in contact with the cushion, thereby eliminating painful pressure points.

In the prior art, an inflatable cushion would have commonly been inflated fully, then allowed to deflate somewhat while a user sits on it. When the user thought sufficient air was released, a valve would have been closed to prevent further deflation of the cushion. The amount of deflation would have been determined by a judgement call of the user. The problem with this method is that the results are very inconsistent. Over-inflation of the cushion does not provide the needed conformability, while under-inflation does not provide enough support. A need exists for a cushion that allows a user to consistently and easily deflate an inflated inflatable cushion to an appropriate height to provide the needed support and conformability.

SUMMARY OF THE INVENTION

An embodiment of the invention is an inflatable cushion having an inflatable bladder. The inflatable bladder has a support positioned therein and a valved exhaust tube in fluid communication with the inflatable bladder. An indicator is coupled to the exhaust tube for indicating when fluid is exiting the exhaust tube.

BRIEF DESCRIPTION OF THE DRAWINGS

In the drawings, in which like reference numerals indicate corresponding parts in all views.

DESCRIPTION OF THE PREFERRED EMBODIMENTS

A description of the preferred embodiments of the present invention will now be had by way of example, and not limitation, with reference to FIGS. 1 through 6.

Figure 1:
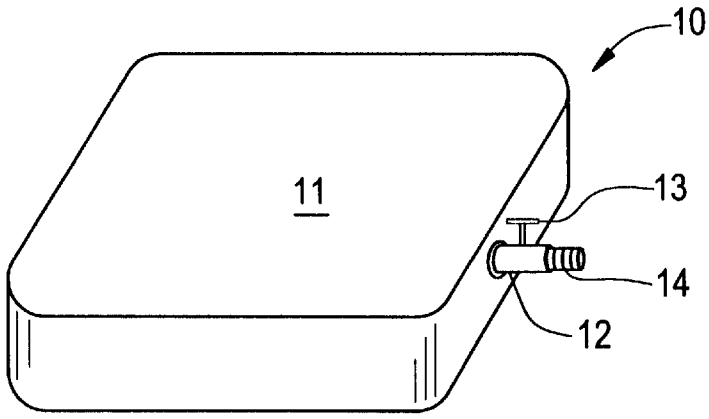
FIG. 1 is a perspective view of a first embodiment of an inflatable cushion.
Figure 2:
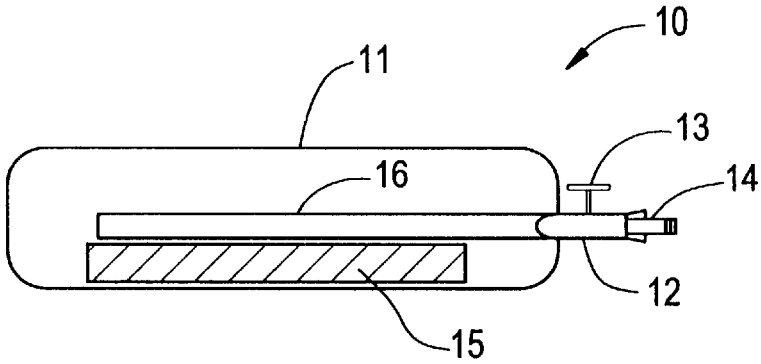
FIG. 2 is a cross-sectional view of the inflatable cushion of FIG. 1.

FIG. 1 is a perspective view of a first embodiment of inflatable cushion 10. FIG. 2 is a cross-sectional view of the same cushion 10. Inflatable cushion 10 has an inflatable bladder 11. The bladder 11 may be inflated with any fluid and is inflated with air in a preferred embodiment. Positioned within inflatable bladder 11 is a support which includes foam element 15 and exhaust channel 16, which lies adjacent a surface of the foam element 15. The foam element 15 may be an open cell foam. Exhaust channel 16 provides fluid communication between the interior of inflatable bladder 11 and exhaust tube 12. The exhaust channel 16 may be made from a thermoplastic material heat sealed to the top of foam element 15. Alternatively, the exhaust channel 16 may be formed from a portion of a thermoplastic material surrounding foam element 15. Exhaust tube 12 has a valve 13 thereon to control airflow through exhaust tube 12. Coupled to the exhaust tube 12 is an audible indicator 14 which emits a sound, e.g. a whistle, when air passes through it, thereby alerting someone using the inflatable cushion 10 that air is escaping and the cushion is deflating. The indicator 14 may be a visual indicator such as a flow meter.

Figure 3:
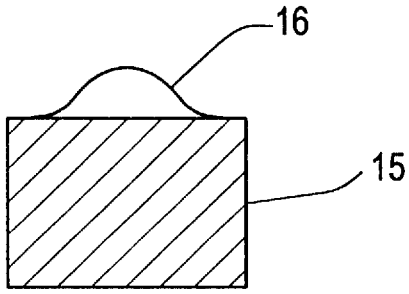
FIG. 3 is an end view of the support of the inflatable cushion of FIG. 2.

FIG. 3 is an end view of the foam element 15 and adjacent exhaust channel 16, which together form the support within inflatable bladder. It can be seen in this view that the interior of the exhaust channel 16 is empty.

Figure 4:
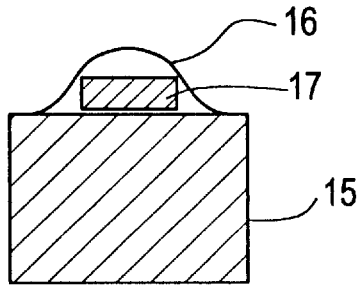
FIG. 4 is an end view of an alternative embodiment of the support of the inflatable cushion of FIG. 2.

FIG. 4 is an end view of an alternative support for use with the inflatable cushion 10 of FIGS. 1 and 2. Like the embodiment of FIG. 3, the support includes foam element 15 and adjacent exhaust channel 16. In this embodiment, however, exhaust channel 16 has a second foam element 17 therein. This foam element 17 helps to retain the exhaust channel 16 in an open position. This prevents premature or unintentional blockage of airflow along the channel 16.

In use, a person sits on the inflatable cushion 10 of FIGS. 1–2 while the inflatable bladder 11 is fully inflated. Valve 13 is opened and the compressive force exerted by the weight of the seated person causes air to escape through exhaust channel 16, exhaust tube 12, and audible indicator 14. Indicator 14 emits a whistle (or other suitable noise) while air is escaping to alert a user to the fact that the cushion 10 is deflating. When the top of the inflatable bladder 11 reaches exhaust channel 16, exhaust channel 16 is compressed against foam element 15, which cuts off the passage of air out of the cushion 10. The user is alerted to this by the fact that the audible indicator 14 reduces intensity or stops making noise. The user then closes valve 13 and the cushion 10 is thereby set at a preselected inflation height.

With regard to the second embodiment, reference will now be made to FIGS. 5 and 6. Inflatable cushion 20 includes an inflatable bladder 21 that has first exhaust tube 22 having a valve 23 thereon to control airflow through the first exhaust tube 22. Coupled to the first exhaust tube 22 is an audible indicator 24, which emits a sound, e.g. a whistle, when air passes through it, thereby alerting someone using the inflatable cushion 20 that air is escaping and the cushion 20 is deflating. The indicator 24 may be a visual indicator such as a flow meter. Positioned within inflatable bladder 21 is a support that includes an inflatable support bladder 25. The bladder 21 and support bladder 25 may be inflated with any fluid and are inflated with air in a preferred embodiment. A second exhaust tube 26 provides fluid communication between inflatable support bladder 25 and second exhaust tube 26. Second exhaust tube 26 has a valve 27 thereon to control airflow through the second exhaust tube 26.

Figure 5:
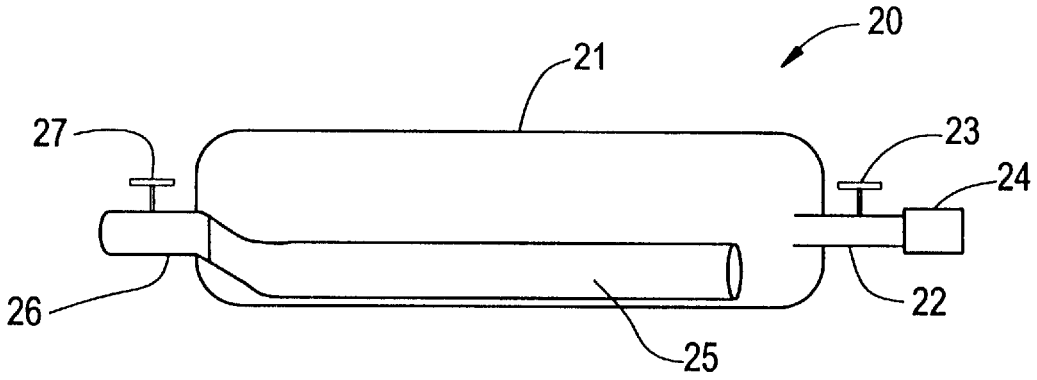
FIG. 5 is a cross-sectional view of a second embodiment of an inflatable cushion prior to application of a compressive force.
Figure 6:
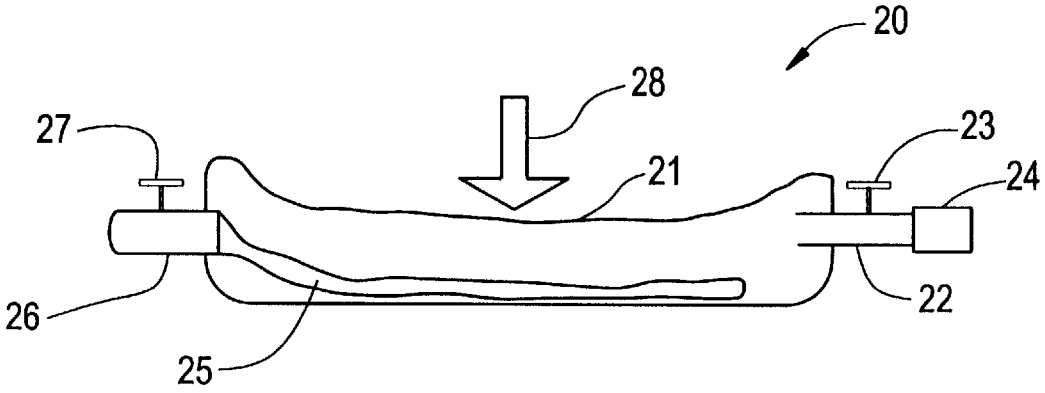
FIG. 6 is a cross-sectional view of the inflatable cushion of FIG. 5 after application of a compressive force and adjustment to a predetermined inflation height.

In use, a person sits on the inflatable cushion 20 of FIGS. 5–6 while the inflatable support bladder 25 and the inflatable bladder 21 are fully inflated and both valves, 23 and 27, are closed. Valve 23 is opened and the compressive force 28 exerted by the weight of the seated person causes air to escape through first exhaust tube 22 and audible indicator 24. Audible indicator 24 emits a whistle (or other suitable noise) while air is escaping to alert a user to the fact that air is escaping and cushion 20 is deflating. When the top of the cushion 21 reaches the inflatable support bladder 25, the person's weight is supported by the inflatable support bladder 25 and air flow through the first exhaust tube 22 decreases or ceases. The user is alerted to this by the fact that the audible indicator 24 reduces intensity or stops making noise. The user then closes first valve 23 and opens second valve 27, whereupon the air in inflatable bladder 25 escapes through second exhaust tube 26. The cushion is thereby set at the preselected inflation height.

It is to be understood the preferred embodiments of this invention herein disclosed and illustrated are by way of illustration, and not limitation, and that changes and modifications can be made without departing from the spirit or scope of this invention.

What is claimed is:

1. An inflatable cushion comprising:

all inflatable bladder, a support positioned within said inflatable bladder, an exhaust tube in fluid communication with said inflatable bladder;

said exhaust tube having a valve thereon; and an indicator coupled to said exhaust tube for indicating when fluid is exiting the exhaust valve;

wherein said support includes an exhaust channel positioned adjacent a surface of said support, said exhaust channel providing fluid communication between said inflatable bladder and said exhaust tube.

2. The inflatable cushion of claim 1, further including a foam element located within the exhaust channel.

3. The inflatable cushion of claim 2, wherein said foam element is open cell foam.

4. The inflatable cushion of claim 1 wherein said support is a foam element.

5. The inflatable cushion of claim 1 wherein said support is an inflatable support bladder.

6. The inflatable cushion of claim 5, further including a second exhaust tube providing fluid communication between the inflatable support bladder and atmosphere.

7. The inflatable cushion of claim 6, wherein said second exhaust tube has a second valve thereon.

8. The inflatable cushion of claim 1 wherein said exhaust channel is joined to said support.

9. The inflatable cushion of claim 8 wherein said exhaust channel is heat sealed to said support.

10. A method of adjusting an inflatable cushion to achieve a predetermined inflation height, wherein the inflatable cushion comprises an inflatable bladder having a top, a bottom, and a valved exhaust tube in fluid communication therewith, a support positioned within the inflatable bladder, and an indicator coupled to the exhaust tube; the method comprising:

inflating the inflatable bladder to a height which exceeds the predetermined inflation height, partially deflating the inflatable cushion by having a person sit upon the top of the inflatable bladder and opening the valve so that the compressive load exerted by the weight of the person causes fluid to exit the exhaust tube and the indicator to indicate fluid flow; and closing the valve when the indicator stops indicating fluid flow, thus indicating that the top of the cushion is in contact with the support.

11. The method of claim 10, wherein the support includes a foam element having an exhaust channel adjacent thereto and in fluid communication with the exhaust tube; the partially deflating the inflatable cushion including applying the compressive load until the top of the inflatable bladder contacts the exhaust channel and compresses it against the foam element, thereby sealing the exhaust channel.

12. The method of claim 10, wherein the support includes an inflatable support bladder having a second valved exhaust tube providing fluid communication between the support bladder and atmosphere; the partially deflating the inflatable cushion including applying the compressive load until the person's weight is supported by the inflatable support bladder, whereupon fluid stops exiting and the indicator stops indicating fluid flow; and further including opening the valve of the second valved exhaust tube after the valve on the exhaust tube of the inflatable bladder is closed, thereby deflating the inflatable support bladder.

* * * * *